United States Patent [19]

Gravesteyn

[11] 3,979,885

[45] Sept. 14, 1976

[54] CAP-LIFTER

[75] Inventor: Elbert Gravesteyn, Leiderdorp, Netherlands

[73] Assignee: Heineken Technisch Beheer B.V., Netherlands

[22] Filed: July 1, 1975

[21] Appl. No.: 592,110

[52] U.S. Cl. ..... 53/381 R; 81/3.46 A

[51] Int. Cl.[2] ..... B65B 43/40

[58] Field of Search ..... 53/381 A; 81/3.3 R, 81/3.46 R, 3.46 A

[56] References Cited

UNITED STATES PATENTS

| | | | |
|---|---|---|---|
| 3,237,289 | 3/1966 | Pearson et al. | 53/381 A X |
| 3,355,856 | 12/1967 | Randrup | 53/381 A X |

*Primary Examiner*—Travis S. McGehee
*Attorney, Agent, or Firm*—Eugene E. Geoffrey, Jr.

[57] ABSTRACT

The invention concerns a machine for removing covers or caps on container closures such as the bung hole closure of bear casks, which are positioned with the closure in downward direction and, in empty condition, pass successively a rinsing station and a filling station to be provided again finally with the said caps. The member for removing the caps is U-shaped and, on the belt, is pivotally connected to a parallel mechanism so that said member, after passing the downwardly extending container edge, can engage the cap side facing the container bottom, thus lifting it from the closure.

3 Claims, 3 Drawing Figures

CAP-LIFTER

The invention relates to a cap lifter for removing covers or caps from container closures such as the bung hole closures of beer casks or the like which are disposed with the closure downwards and which returned in empty condition and destined for being positioned on a conveyor belt with a rinsing station following the cap lifter, a filling station and a subsequent capsulating machine, which cap lifter is provided with a member engaging the cap side facing the container and subsequently downwardly stripping the cap from the closure, for removing repetitiously a cap from a container.

Such a cap lifting machine is known. In this machine not only the member stripping the cap or such-like member which is bicomponent has to execute different movements, but a lifting and a tilting movement has also to be imparted to the container, thus making this known machine very complicated.

It is an object of the present invention to provide a cap lifter which operates effectively and fully automatically and being of a simple construction.

To this effect the cap lifter according to the present invention is so constructed that said member is attached on the one horizontal rod of a parallel mechanism, which horizontal side is pivotally connected at or adjacent its ends to two mutually parallel swivelling arms, whose swivelling angle is so large that the member upon arrival of a container on the conveyor belt, coincides with its top side with the top surface of said belt and, after passing the edge of the container, is pressed down by spring means and subsequently lifted at the cap engaging level.

The above arrangement ensures that the container, in particular the beer cask, operates the machine by pressing downwards the member with its leading edge so that the advancing movement of the beer cask is not interrupted, and subsequently the cover or cap is engaged and lifted and the trailing edge can also be moved over the member unimpeded. The whole machine operates fully automatically, so that a change in position of the beer cask is unnecessary.

A non-limitative embodiment of the invention will now be explained by way of example, with reference to the accompanying drawings, schematically showing:

FIG. 1 a side view of the cap lifter;

Figure 1:
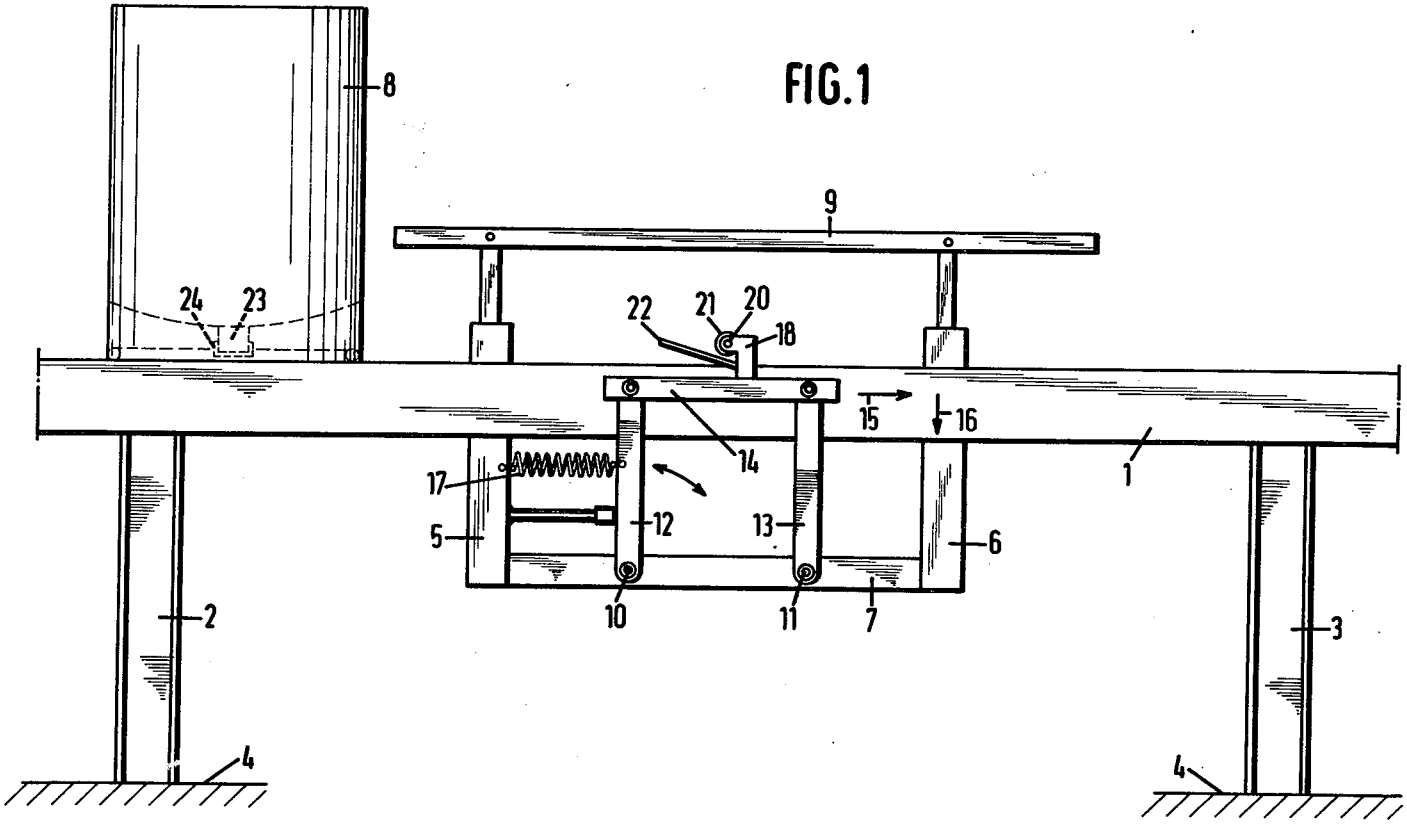
Figure 3:
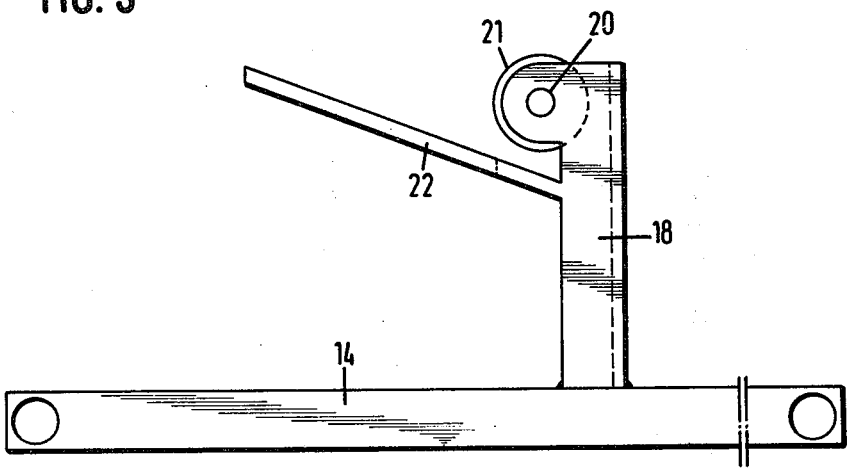
FIG. 3 shows said detail from aside.

The cap lifter comprises a frame having a U-shaped top longitudinal girder accommodating a chain conveyor, not shown. The frame stand on legs 2, 3 on the job site floor 4. There is mounted an auxiliary frame on the top longitudinal girder 1, consisting of two vertical rods 5, 6 which project partly above and partly underneath the U-shaped girder 1 and being connected at their bottom ends by a horizontal girder 7. On the top ends of the rods there is mounted a guide rod 9 for centrally maintaining on the chain conveyor the arriving beer casks, one of which being shown in FIG. 1 and indicated by 8. If necessary, there may be such an auxiliary frame with guide rod on either side of the U-shaped longitudinal girder.

Figure 2:
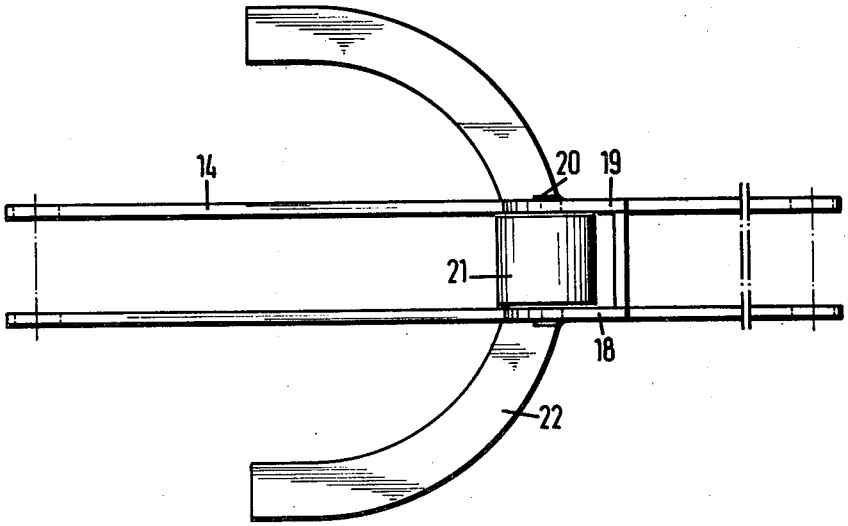
FIG. 2 shows, on an enlarged scale, a detail in top view.

On said horizontal girder 7 of the auxiliary frame there are mounted about two spaced apart pivot pins 10, 11 swivelling arms 12, 13 which are pivotally connected with their top ends to a horizontal rod 14. The girder 7, the arms 12, 13 and the rod 14 from a parallelogram system wherein the rod 14 can be moved according to arrow 15, descending according to arrow 16 under influence of forces extending a spring 17 connected to the rod 5. On the rod 14 is positioned the cap lifter proper, which consists of two angle irons 18, 19 with, at their free ends, a transverse shaft 20 whereon is mounted a guide roller 21. To the angle irons there is attached a U-shaped member 22 (see especially FIG. 2) slanting upwardly but remaining with its open end just under the highest point of the guide roller 21.

The machine operates as follows.

The casks 8 arrive with their closure 23 facing downwardly. When they have attained the free end of the U-shaped member 22, said member, through the stop positioned in said location, can move according the arrow 15 against the force of the spring 17. This causes the rod 14 to move as well but it is forced to descend by the swivelling arms 12, 13 to such extent that the cask edge contacts the guide roller 21, thus pushing the cap lifter 22 proper underneath the cask edge. When the guide roller 21 too has passed the cask edge, the spring 17 is contracted so that the rod 14 with the interconnected portions moves in a direction opposite to the arrows 15 and 16, and the U-shaped member 22 encompassing the closure 23. When the advancing motion of the beer cask continues, a cap 24 present on the closure is lifted from the closure owing to the oblique position of the member 22.

Subsequently, the free end of member 22 abuts the trailing portion of the cask edge and the movement of arrows 15 and 16 are repeated.

When the rod 14 has sufficiently descended again, the member is pushed underneath said edge portion, the guide roller 21 having a friction-reducing effect.

Now a cap can be stripped from the next cask, the whole process being repeated.

It will be clear that the structural changes of the cap lifter are possible within the scope of the present invention.

For instance it is possible with a specific shape of closure 23 and/or with a slight clamping of the cover, to reduce the U-shaped member to minimal proportions viz. only that portion which is present under the guide roller 21.

For the same reasons it is also possible to replace the parallel mechanism by the simple pivoting arm 12. The cap lifting member is then disposed at the and of said arm 12, the arm lying in the extension of 18 and 19; the horizontal rod 14 is then naturally left out.

I claim:

1. A cap lifter for removing caps or closures from container openings such as the bung hole closures of beer casks and the like wherein the opening is positioned in the downward position comprising a conveyor for transporting said containers, cap removing means for removing caps from said containers including a horizontal member disposed beneath said conveyor, a horizontal rod at the level of said conveyor and coupled by spaced parallel arms to said horizontal member, means for normally retaining said horizontal rod at the level of said conveyor and adapted to swivel downwardly upon engagement of a container opening as the latter is moved by the conveyor, a cap lifter carried by said horizontal rod and engaging the upper side of said cap whereupon forward displacement of the container moves the horizontal rod and cap lifter downwardly to remove said cap, the horizontal rod then returning to the upper position in preparation for engaging the cap of the next successive container.

2. A cap lifter according to claim 1, wherein the cap lifter consists of a U-shaped member, of which the open side faces in the direction opposite to the movement of the conveyor belt.

3. A cap lifter according to claim 2, wherein a guide roller is centrally disposed above the closed end of the U-shaped member.

* * * * *